US006698025B1

(12) United States Patent
Hughes

(10) Patent No.: US 6,698,025 B1
(45) Date of Patent: Mar. 2, 2004

(54) MULTI-GARMENT OUTFIT WITH NONTRADITIONAL ACCESS

(75) Inventor: Jennifer L. Hughes, Traverse City, MI (US)

(73) Assignee: Liloebe, LLC, Traverse City, MI (US)

( * ) Notice: Subject to any disclaimer, the term of this patent is extended or adjusted under 35 U.S.C. 154(b) by 0 days.

(21) Appl. No.: 10/227,311

(22) Filed: Aug. 26, 2002

(51) Int. Cl.[7] ..... A61D 11/00
(52) U.S. Cl. ..... 2/69; 2/80
(58) Field of Search ..... 2/70, 69.5, 71, 2/72, 73, 74, 75, 80, 83, 111, 114, 128, 69, 67; D2/845, 854, 842

(56) References Cited

U.S. PATENT DOCUMENTS

| | | | | | |
|---|---|---|---|---|---|
| 1,001,538 | A | | 8/1911 | Linker | |
| 1,188,052 | A | * | 6/1916 | Edwards | 2/80 |
| 1,255,491 | A | * | 2/1918 | Verde | 2/80 |
| 1,311,600 | A | | 7/1919 | Fiore | |
| 1,395,115 | A | * | 10/1921 | Jaslow | 2/80 |
| 1,405,694 | A | | 2/1922 | Talianoff | |
| 1,412,683 | A | * | 4/1922 | Gribbie | 2/71 |
| 1,424,318 | A | | 8/1922 | Nester | |
| 1,491,540 | A | * | 4/1924 | Kuh | 2/80 |
| 1,758,740 | A | * | 5/1930 | Gale | 2/78.2 |
| 1,945,747 | A | * | 2/1934 | Martin | 2/70 |
| 1,984,310 | A | * | 12/1934 | Lakritz | 2/80 |
| 2,010,393 | A | | 8/1935 | Hailey | |
| 2,121,304 | A | | 6/1938 | Rosenbloom | |
| 2,291,861 | A | * | 8/1942 | Astrove | 2/80 |
| 2,331,626 | A | | 10/1943 | Perlitch | |
| 2,338,552 | A | * | 1/1944 | Stephenson | 2/269 |
| 2,385,871 | A | | 10/1945 | Liebert | |
| 2,425,402 | A | | 8/1947 | Sieloff | |
| 2,523,416 | A | * | 9/1950 | Brennan | 2/80 |
| 2,564,369 | A | * | 8/1951 | Miller | 2/71 |
| 2,580,969 | A | * | 1/1952 | Stephenson | 2/80 |
| 2,714,718 | A | * | 8/1955 | Krame | 2/70 |
| 2,808,590 | A | * | 10/1957 | Siegel et al. | 2/80 |
| 3,002,193 | A | * | 10/1961 | Briskman | 2/72 |
| 3,628,192 | A | * | 12/1971 | Artz | 2/130 |
| 4,697,288 | A | * | 10/1987 | Palumbo | 2/269 |
| 5,084,914 | A | * | 2/1992 | Hesch | 2/79 |
| 5,564,123 | A | | 10/1996 | Grassick | |
| 5,611,086 | A | * | 3/1997 | Eggen | 2/104 |
| 5,689,832 | A | * | 11/1997 | Head | 2/227 |
| 6,032,287 | A | | 3/2000 | Kallas | |
| 6,202,220 | B1 | * | 3/2001 | Rhoden | 2/236 |
| 6,243,871 | B1 | * | 6/2001 | Fidler | 2/80 |
| 6,260,200 | B1 | * | 7/2001 | Alfred | 2/69 |

OTHER PUBLICATIONS

Children's Boutique, www.childrenboutique.com, item#8760 Boys Baptism.*
www.heirloomgowns.com, Zachary– one piece romper.*
JCPenny Catalog: Christmas 1975, p. 187, item D.*

* cited by examiner

*Primary Examiner*—John J. Calvert
*Assistant Examiner*—Alissa L Hoey
(74) *Attorney, Agent, or Firm*—Northern Michigan Patent Law, PLC

(57) ABSTRACT

A clothing outfit particularly adapted for infants in which normally separate, distinct garments of a type ordinarily considered more grown-up or adult are combined to form a one-piece outfit that can be put on and taken off in one piece, but that retains the appearance of separately donned garments. Customary infant access features are added to top and/or bottom portions of the garment so that the outfit can be put on and taken off in one piece. The impression of the outfit as a more adult combination of separates is enhanced by visually minimizing or hiding the customary infant access features, and further by providing non-functional but visible adult access features.

13 Claims, 4 Drawing Sheets

MULTI-GARMENT OUTFIT WITH NONTRADITIONAL ACCESS

FIELD OF THE INVENTION

The present invention is generally in the field of infants' and children's clothing.

BACKGROUND OF THE INVENTION

Infant clothing is often provided in one-piece outfits for ease of dressing and changing, using special infant access features such as crotch and shoulder snaps and zippers to make it easier to slip the outfit on and off and for changing diapers. Such outfits look distinctly like infants' clothing, and by the time a child is two or three are relegated to pajama wear or simply not used so that the child can be dressed in more "grown-up" looking multi-piece outfits. Multi-piece outfits comprising separate items of clothing are also generally easier to put on and take off an older child.

BRIEF SUMMARY OF THE INVENTION

The present invention is a one-piece outfit especially for infants, in which adult-looking or "grown-up" separates not traditionally worn by infants are combined in a single garment that maintains the grown-up, multi-garment appearance of the separates while providing discreet, customary infant access, top and/or bottom, and while providing the overall practicality of a one-piece outfit that simplifies dressing and undressing and stays intact during activity.

This outfit is especially designed for infants because one-piece outfits tend to be less practical for active older children. However, the inventive outfit may also be useful for certain handicapped and elderly individuals where the circumstances warrant a one-piece outfit. In these cases the individual can maintain a sophisticated "separates" appearance while eliminating twisting and untucking of layers and complex mixing and matching of separates which may be beyond the ability or patience of the individual or a caregiver. The customary infant access features provide easy access for bathroom needs or undergarment changing.

The seams where the separates are joined are minimized or camouflaged, and the infant access features are also minimized or hidden by blending them in color- or patternwise or hiding them underneath false "adult" closures or clothing features such as non-functional button plackets, epaulettes, and seams. Minimizing or hiding these customary infant access features is desirable especially since the separates being combined are not normally provided with such features.

The outfit may also include integrated "false" or partial garments that give the impression of full garments layered with the other garments in the outfit.

These and other features and advantages of the invention will become apparent upon reading the specification below in light of the drawings.

DETAILED DESCRIPTION OF THE DRAWINGS

Figure 1:
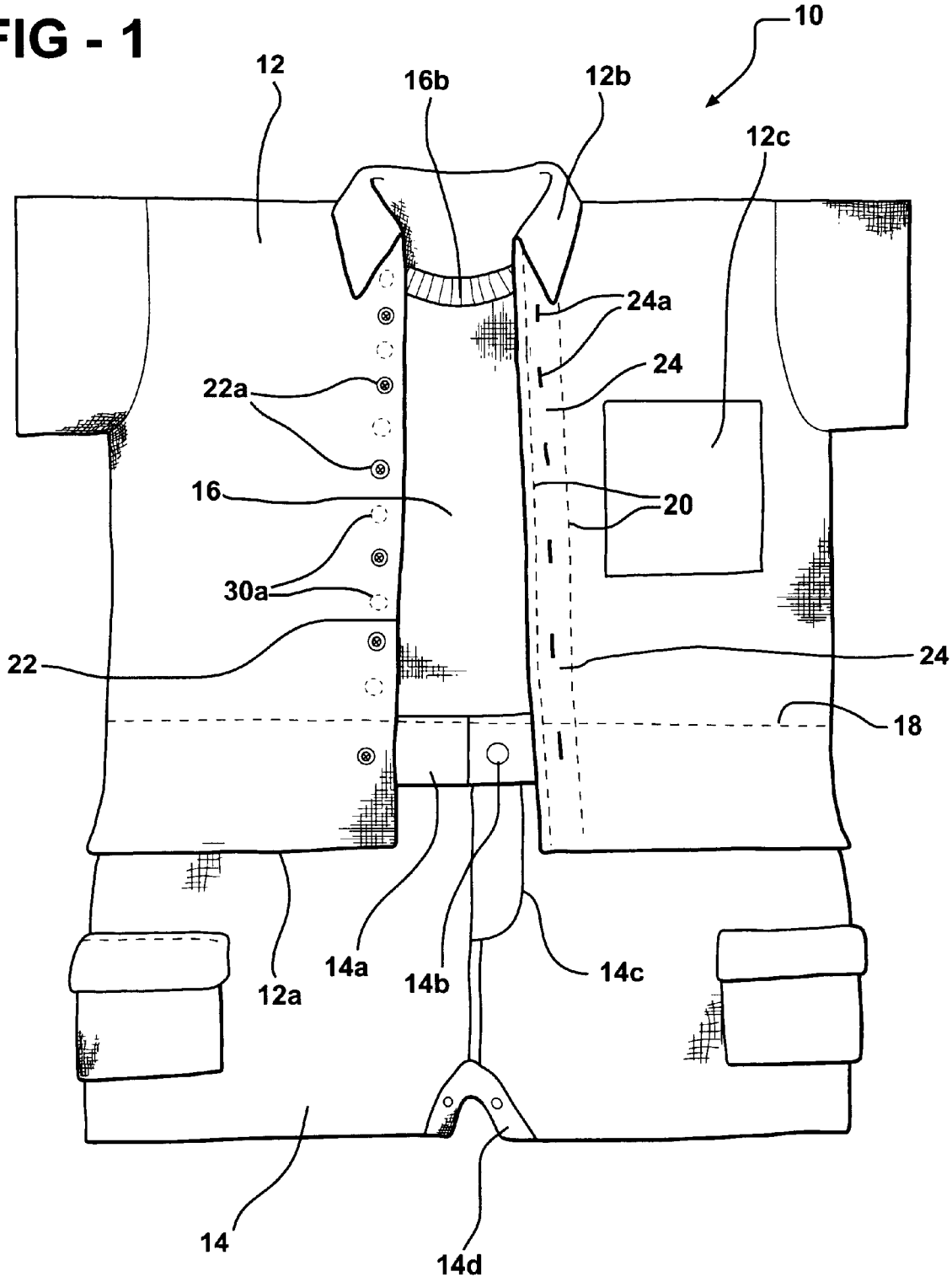
FIG. 1 is a front elevational view of an infant's outfit according to the present invention.
Figure 2:
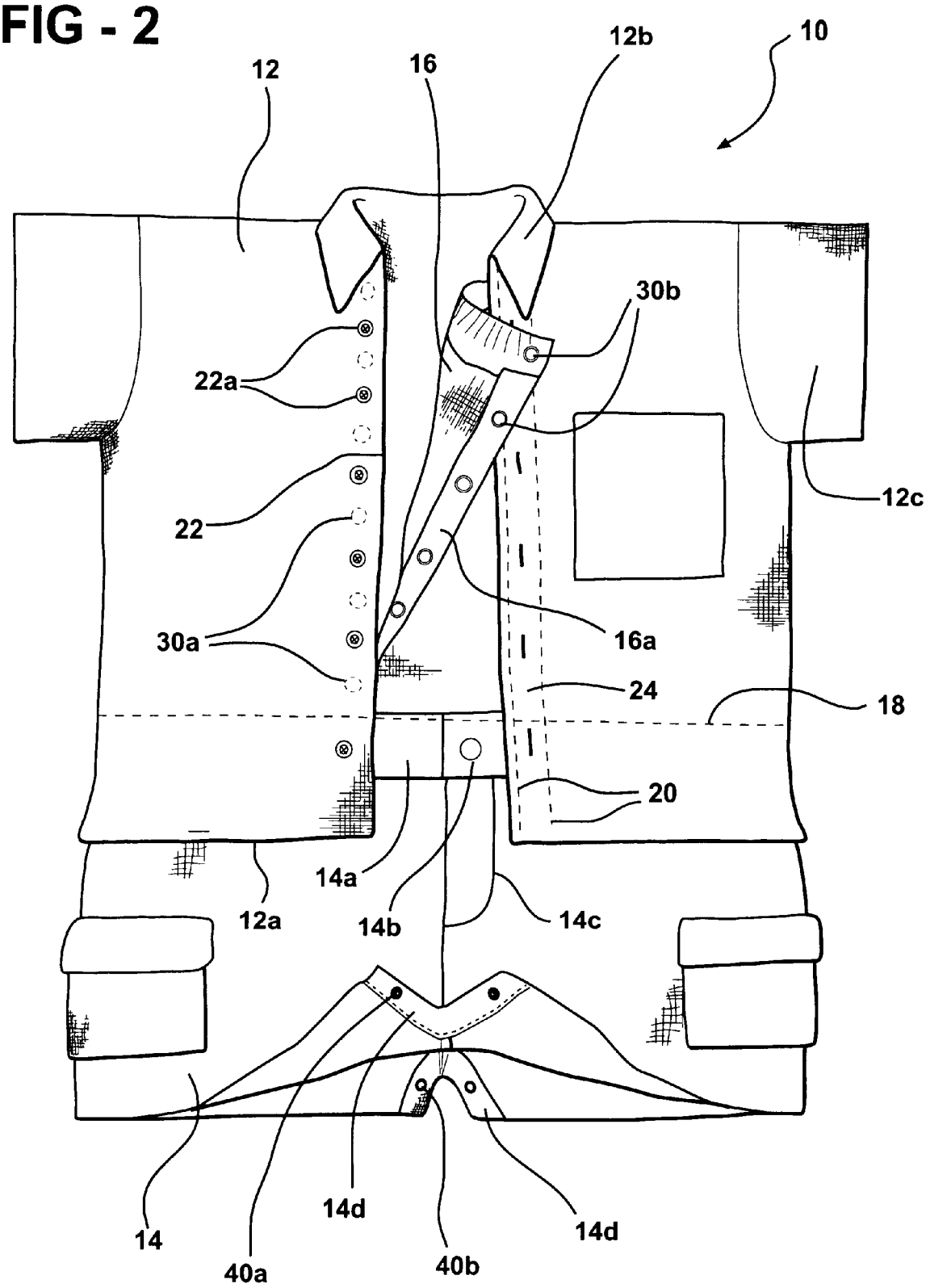
FIG. 2 shows the customary infant access features of the outfit of FIG. 1 opened up, and further illustrates a manner in which at least some of the access features can be camouflaged.

Referring first to FIGS. 1 and 2, an exemplary infant's outfit 10 according to the invention includes a shirt portion 12, a shorts or pants portion 14, and a false t-shirt portion 16 layered under the shirt 12. These normally separate garments are joined into one-piece outfit 10 by a waist seam 18 joining lower portions of the shirts circumferentially to the shorts, and one or more placket seams 20 joining t-shirt 16 to the inside of the buttonhole placket 24. Outfit 10 is accordingly put on an infant in one piece, and taken off in one piece.

Because the separate items of clothing integrated into outfit 10 do not have infant access features as adult or older-child separates, customary infant access features are provided top and bottom on outfit 10 to facilitate dressing, undressing, and diaper changing. Male snaps 30*a* of a type commonly used in infant clothing are secured to the inside of button placket 22, hidden underneath the placket as indicated by the phantom lines in FIGS. 1 and 2 and preferably placed in-between the locations where the exterior buttons 22*a* are sewn through. Mating female snaps 30*b* are secured to the inside hem 16*a* of false t-shirt 16, also hidden underneath the button placket 22 when the snaps are mated, as shown in FIG. 1. The front and rear inseams 14*d* of shorts 14 are not sewn together, but are openable and closable in customary infant fashion via male and female snaps 40*a* and 40*b* that preferably are visually minimized by coloring the snaps to match the inseam fabric, and possibly hidden from view using a tucked seam or by placing an extra layer of fabric over the snaps on each seam. Accordingly, outfit 10 has the appearance of three separate, layered, "grown-up" items of clothing.

The illusion of an outfit chosen from and donned as separates is further enhanced by the non-functional "adult" closure or access features retained or built into one or more of the shirt 12, shorts 14, and t-shirt 16. Shirt button placket 22 with buttons 22*a* and buttonhole placket 24 with buttonholes 24*a* give the appearance of a shirt capable of being buttoned and put on or taken off in normal fashion, but are non-functional in the sense that the shirt portion 12 cannot be buttoned because the plackets are spaced too far apart and are sewn to the t-shirt portion underneath, and cannot be put on or taken off in normal fashion because it is joined at the waist with shorts portion 14. Waist 14*a* with standard snap or button closure 14*b* and fly 14*c* give the appearance of shorts that can be pulled on and off and otherwise accessed in normal fashion, but from the standpoint of putting the shorts on and taking them off are non-functional. The standard neckline 16*b* on false t-shirt 16 gives the appearance of a separate t-shirt that can be pulled on and off over the head in normal fashion.

Other features that can enhance the impression that outfit 10 actually comprises separates include leaving the bottom hem 12*a* of the shirt free-hanging; leaving ample material in the false t-shirt above the waist 14*a* to give the appearance of it being baggy or loosely tucked-in; using contrasting, adult colors and patterns for each of the items in the outfit, rather than typical infant-style coordinate schemes; and minimizing or hiding joinder seams 18 and 20 by using thread matching the outermost layer in color, covering them with accessories, or using normal "separates" seams for double-duty. The joinder seams 20 in buttonhole placket 24 are the same seams normally visible in buttonhole plackets, but in outfit 10 the seams are sewn through t-shirt 16 as well. The visible portion of waist joinder seam 18 between the open plackets of shirt 12 can be the same seam normally found on the waist of a separate pair of shorts or pants. Such subtle attributes can greatly enhance the subjective impression outfit 10 makes on those around the wearer, reinforcing the impression of adult-style separates.

It will be apparent to those skilled in the clothing art that outfit 10 can be fashioned from actual clothing separates (shirt, t-shirt, and shorts) by altering and/or sewing them together as described above and adding the infant access features. However, because such adult-style separates are not commonly found in infant sizes and may not be easily altered or sewn together to achieve the look of a properly layered outfit, and because even if available as infant-size separates they do not need the access features common in more typical one-piece infant outfits, the outfit 10 can be manufactured originally as a one-piece outfit from suitable fabrics.

Figure 3:
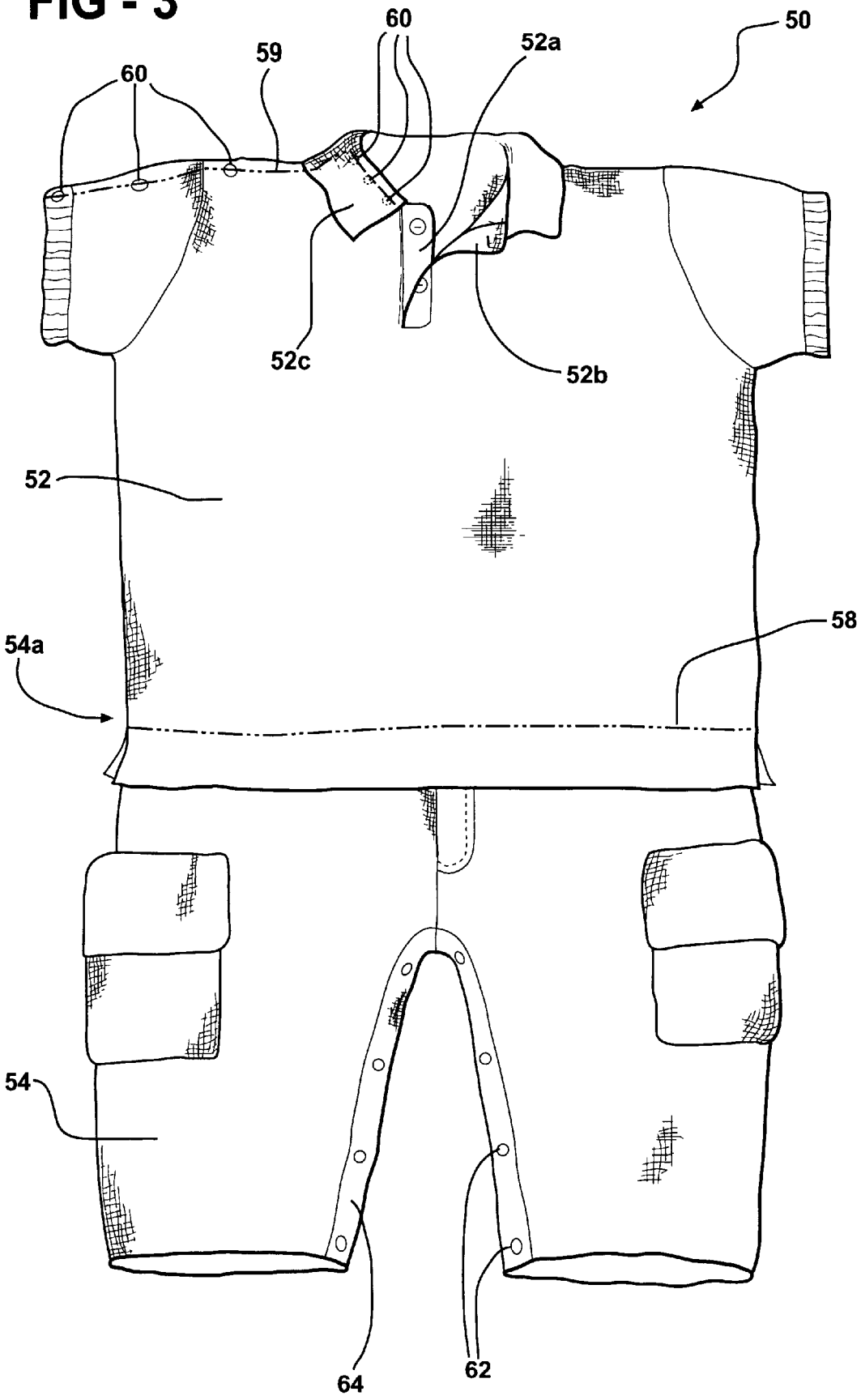
FIG. 3 is a front elevational view of an alternate outfit according to the present invention, with the upper shirt portion having customary infant access features as well as non-functional adult access and fastening features.

Referring to FIG. 3, a two-garment embodiment is illustrated as outfit 50 having the appearance of a "polo" shirt 52 and pants 54. Shirt portion 52 is sewn circumferentially to pants portion 54 around waist 54*a* at a seam 58 (phantom line). The hem of the shirt is left hanging freely over the waist of the pants, rather than being tucked in, to enhance the look of a separates outfit. The upper hem line of the shirt and the seam 58 joining the shirt to the pants are the same to further enhance the appearance of a normal, separate shirt of this type with no apparent connection to the pants. Vents or side slits 52*d* typical of this shirt style are also provided on each side of the hem below the joinder seam 58. By way of example the polo shirt can be a navy blue and the pants a khaki color.

Shirt portion 52 has a two-button placket closure 52*a*, 52*b* at the neck in typical adult fashion, which, although it can be buttoned or unbuttoned for aesthetic purposes, is non-functional in the sense that the shirt portion cannot be put on or taken off over the head via the unbuttoned neck opening alone. Instead, customary infant access slit or placket opening 59 with snaps 60 is formed along one sleeve and shoulder seam and under one side of the collar to allow one complete side of the top edge of the outfit to be opened up for dressing and undressing. Some of snaps 60 are hidden under the collar 12*b* (phantom lines), while along the shoulder opening, where hiding them completely is less practical, the snaps are minimized by making them the same color as the shirt portion. The adult-style two-button collar opening will tend to draw attention away from any visible snaps 60 in any event.

In addition to, or instead of, top infant access opening 59, pants portion 54 is provided with customary infant snaps 62 along openable inseams 64, preferably hidden under an outer layer of seam material or at least minimized by blending them in colorwise.

Figure 4:
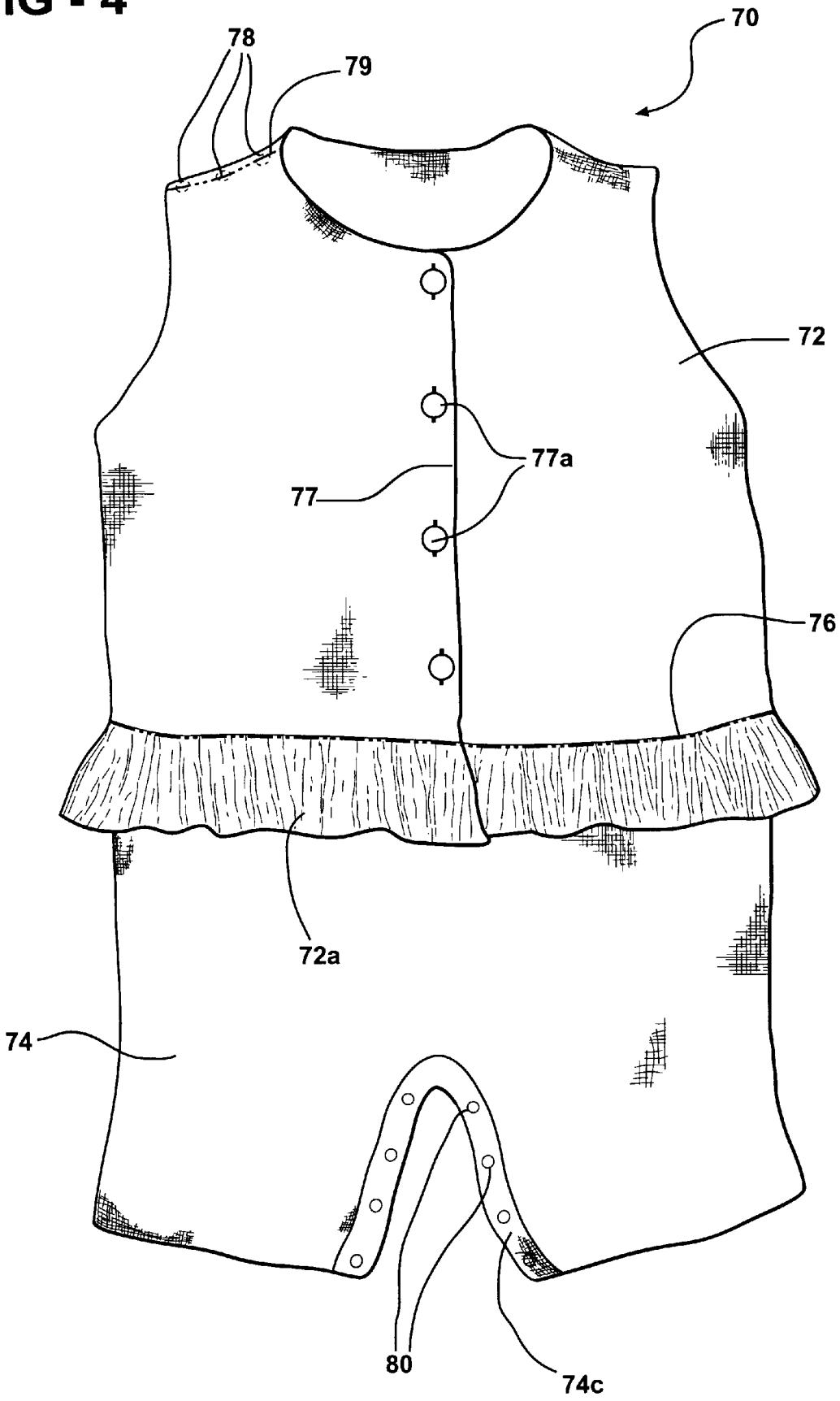
FIG. 4 is similar to FIG. 3 in showing both customary infant access and adult closures, representing a girl's outfit according to the invention.

Referring to FIG. 4, a girl's two-piece outfit 70 includes a blouse portion 72 and a capri-length pants portion 74. Joinder of the two disparate-looking garments is again via a circumferential waist seam 76 that doubles as the normally-visible seam for attaching a lower ruffle portion 72*a* to the blouse 72. By way of example, blouse 72 may be of a typical light blouse material in a flower print or plaid, while the pants portion 74 may be a solid linen or denim fabric. The more different the materials and fabrics, the more that outfit 70 maintains the appearance of separates. A button placket 77 and buttons 77*a* grace the front of the blouse portion (with corresponding buttonholes). Customary infant access is additionally provided in pants 74 with a row of camouflaged or hidden snaps 80 (phantom lines) along the inseam. Buttons 77*a* can be real buttons capable of opening and closing the front of the blouse 72 partially or to the waist, although the blouse cannot be put on and taken off like a separate blouse due to its being sewn to pants 74; buttons 77*a* and any opening they provide complement the customary infant access snaps at the inseam of the pants. Alternately, buttons 77*a* could be sewn in place without any true opening in the front of the blouse, and customary infant access snaps 78 along a shoulder seam opening 79 could be provided to complement the inseam access in the pants.

It will be apparent to those skilled in the art that the foregoing illustrated examples of the invention are but a few of the possible ways to carry it out. While two and three piece outfits have been shown, outfits that appear to have more than two or three pieces are certainly possible and within the scope of the invention. The number and type of adult-looking accessories that can be added permanently or temporarily, such as a false or even a real belt in the outfit of FIG. 1, is unlimited. Shirts, blouses, pants and shorts are but a few possible combinations, since dresses, sportcoat and suit combinations, athletic outfits, and many casual fashions and even formalwear can be adapted to the inventive outfit. The exemplary infant access features shown as slit or placket-type openings or openable seams with snaps are only a few of the possible variants that can be used to provide top and/or bottom access, including but not limited to full and partial openings in different locations on the garments and the use of other known types of fasteners such as zippers, hook-and-loop, and buttons. Outfits according to the invention are readily adaptable to larger-than-infant sizes for use by the handicapped and elderly or their caregivers. These and other modifications will be apparent to those skilled in the art now that I have disclosed the foregoing embodiments.

I accordingly claim:

1. A one-piece infant's clothing outfit with the appearance of two or more separately-donned items of clothing, comprising a top outer garment of a type normally formed as a separate adult garment and a distinct bottom outer garment normally formed as a separate adult garment, the top and bottom outer garments being permanently joined to form a single infant garment that must be put on and taken off in one piece, the outfit having a customary infant access opening in at least one of the top and bottom outer garments, wherein the outfit further includes a false garment layer associated with one of the top and bottom outer garments and the false garment layer is associated with the customary infant access opening.

2. A one-piece infant's clothing outfit with the appearance of two or more separately-donned items of clothing, comprising a top outer garment of a type normally formed as a separate adult garment and a distinct bottom outer garment normally formed as a separate adult garment, the top and bottom outer garments being permanently joined to form a single infant garment that must be put on and taken off in one piece, the outfit having a customary infant access opening in at least one of the top and bottom outer garments, wherein the top and bottom outer garments are joined in a place and manner in which the joinder is visually minimized or hidden, and wherein the customary infant access is visually minimized or hidden by an external feature of one of the top and bottom outer garment portions normally found in such an outer garment when formed as a separate garment.

3. A one-piece infant's clothing outfit with the appearance of two or more separately-donned items of clothing, comprising a top outer garment of a type normally formed as a separate adult garment and a distinct bottom outer garment normally formed as a separate adult garment, the top and bottom outer garments being permanently joined to form a single infant garment that must be put on and taken off in one piece, the outfit having a customary infant access opening in at least one of the top and bottom outer garments, wherein a lower hem portion of the top outer garment overhangs an upper portion of the lower outer garment corresponding to the waist region of the wearer to give the appearance of a separate top outer garment that is freely hanging over the lower outer garment.

4. The one-piece infant's clothing outfit of claim 3, wherein the top outer garment is permanently joined to the lower outer garment above the lower hem portion of the top outer garment.

5. The one-piece infant's clothing outfit of claim 4, wherein the top outer garment is a shirt/blouse type garment of the kind that can be tucked into pants or shorts, and the lower outer garment is a pants/shorts type garment.

6. The one-piece infant's clothing outfit of claim 5, wherein a waist portion of the lower outer garment is exposed between spaced overhanging portions of the top outer garment.

7. The one-piece infant's clothing outfit of claim 6, wherein a false top garment underlayer is located and visible between spaced portions of the top outer garment above the lower outer garment.

8. The one-piece infant's clothing outfit of claim 7, wherein the false top garment underlayer has the appearance of being tucked into the waist portion of the lower outer garment.

9. The one-piece infant's clothing outfit of claim 4, wherein the top outer garment is permanently joined to the lower outer garment at a waist portion of the lower outer garment.

10. The one-piece infant's clothing outfit of claim 3, wherein the top outer garment is a shirt/blouse type garment of the kind that can be tucked into pants or shorts, and the lower outer garment is a pants/shorts type garment.

11. The one-piece infant's clothing outfit of claim 3, wherein a waist portion of the lower outer garment is exposed between spaced overhanging portions of the top outer garment.

12. The one-piece infant's clothing outfit of claim 3, wherein a false top garment underlayer is located and visible between spaced portions of the top outer garment above the lower outer garment.

13. The one-piece infant's clothing outfit of claim 12, wherein a waist portion of the lower outer garment is exposed between spaced overhanging portions of the top outer garment, and the false top garment underlayer has the appearance of being tucked into the waist portion of the lower outer garment.

* * * * *